US008664878B2

(12) United States Patent
Choudhury et al.

(10) Patent No.: US 8,664,878 B2
(45) Date of Patent: Mar. 4, 2014

(54) BALLAST WITH AN ARC QUENCHING CIRCUIT

(75) Inventors: Ayan Choudhury, Danvers, MA (US); Arindam Chakraborty, Chicago, IL (US)

(73) Assignee: OSRAM SYLVANIA Inc., Danvers, MA (US)

( * ) Notice: Subject to any disclaimer, the term of this patent is extended or adjusted under 35 U.S.C. 154(b) by 150 days.

(21) Appl. No.: 13/345,953

(22) Filed: Jan. 9, 2012

(65) Prior Publication Data

US 2013/0175939 A1 Jul. 11, 2013

(51) Int. Cl.
*H05B 41/16* (2006.01)

(52) U.S. Cl.
USPC ..... 315/276; 315/206; 315/308

(58) Field of Classification Search
USPC ..... 315/200 R, 206, 224, 274–277, 307, 315/308, 312, 313
See application file for complete search history.

(56) References Cited

U.S. PATENT DOCUMENTS 5,083,065 A * 1/1992 Sakata et al. ..... 315/307
5,805,398 A * 9/1998 Rae ..... 361/42
5,982,113 A 11/1999 Crouse et al.
6,292,339 B1 9/2001 Brooks
6,836,077 B2 * 12/2004 Nerone ..... 315/209 R
7,723,924 B2 * 5/2010 Han et al. ..... 315/224
8,299,727 B1 10/2012 Xiong et al.

FOREIGN PATENT DOCUMENTS

EP 0 439 248 A2 7/1991

OTHER PUBLICATIONS

Colm Hagan, International Search Report and Written Opinion of the International Searching Authority for PCT/US2013/020643, Jun. 25, 2013, pp. 1-10, European Patent Office, Rijswijk, The Netherlands.

* cited by examiner

*Primary Examiner* — Tung X Le
(74) *Attorney, Agent, or Firm* — Shaun P. Montana

(57) ABSTRACT

An arc detection circuit that detects an occurrence of arcing between ballast and a lamp is provided. A transformer has a primary side connected between the ballast and the lamp to receive lamp current and conduct the lamp current from the ballast to the lamp during normal operation. A secondary side of the transformer produces a transformer voltage as a function of the lamp current received by the primary side. The produced transformer voltage is less than a threshold value during normal operation and greater than the threshold value during an occurrence of arcing between the ballast and the lamp. The arc detection circuit reduces the produced transformer voltage and provides it to the ballast so as to shut down the ballast operation.

19 Claims, 2 Drawing Sheets

BALLAST WITH AN ARC QUENCHING CIRCUIT

TECHNICAL FIELD

The present invention relates to lighting, and more specifically, to electronic ballasts for lighting.

BACKGROUND

Arcing is the electrical breakdown of a gas that produces an ongoing discharge resulting from a current flowing through a normally non-conductive media, such as air. In lamp systems, arcing often occurs when there is a small air gap between the terminals that electrically connect an electronic ballast to a lamp. For example, a small air gap is often created between ballast connector terminals and lamp pins when the lamp is removed from the ballast.

The occurrence of arcing in lamp systems can cause serious damage to the ballast and to the lamp, as well as creating a safety hazard. Arcing, particularly when it is prolonged, results in a deposition of carbon at the ballast connector terminals, and may cause flashover of the ballast connector terminals and the lamp pins. These conditions may lead to the malfunctioning of the ballast and/or the generation of a serious fire.

SUMMARY

Embodiments of the present invention provide a ballast having an arc quenching circuit that detects an occurrence of an arc and then quenches it. Thus, embodiments facilitate consistent performance of a ballast and one or more lamps connected thereto, even in the event of arcing that may occur for any reason.

In one embodiment, an arc detection circuit is configured for connecting between a ballast and a lamp. The arc detection circuit includes a transformer having a primary side and a secondary side. The primary side is configured for connecting between the ballast and the lamp to receive lamp current and conduct the lamp current from the ballast to the lamp during normal operation. The secondary side of the transformer produces a transformer voltage as a function of the lamp current received by the primary side. The produced transformer voltage is less than a threshold value during normal operation and the produced transformer voltage is greater than the threshold value during an arcing occurrence between the ballast and the lamp.

The arc detection circuit includes a first Zener diode and a second Zener diode connected together in series to the secondary side of the transformer. Each of the first Zener diode and the second Zener diode has an anode and a cathode. The anode of the first Zener diode is connected to the cathode of the second Zener diode, and the cathode of the first Zener diode is connected to the secondary side of the transformer for receiving the produced transformer voltage. The anode of the second Zener diode is connected to ground potential. The first Zener diode has a first reverse breakdown voltage that corresponds to the threshold value so that the produced transformer voltage is provided to the second Zener diode during an arcing occurrence, and the produced transformer voltage is blocked from the second Zener diode during normal operation. The second Zener diode has a second reverse breakdown voltage for reducing the produced transformer voltage provided thereto.

The arc detection circuit includes an output terminal connected to the second Zener diode for providing the reduced produced transformer voltage to the ballast to indicate an arcing occurrence has been detected. In response to receiving the reduced produced transformer voltage, the ballast shuts down and thus quenches the arcing and prevents potential damage and safety hazards that may result from the arcing occurrence.

In an embodiment, there is provided an arc detection circuit to detect an occurrence of arcing between a ballast and a lamp. The arc detection circuit includes: a transformer having a primary side and a secondary side, wherein the primary side is configured for connecting between the ballast and the lamp to receive lamp current and conduct the lamp current from the ballast to the lamp during normal operation, wherein the secondary side of the transformer produces a transformer voltage as a function of the lamp current received by the primary side, and wherein the produced transformer voltage is less than a threshold value during normal operation and is greater than the threshold value during an occurrence of arcing between the ballast and the lamp; a first Zener diode and a second Zener diode connected together in series to the secondary side of the transformer, each of the first Zener diode and the second Zener diode having an anode and a cathode, the anode of the first Zener diode connected to the cathode of the second Zener diode, the cathode of the first Zener diode connected to the secondary side of the transformer to receive the produced transformer voltage, the anode of the second Zener diode connected to ground potential, wherein the first Zener diode has a first reverse breakdown voltage that corresponds to the threshold value so that the produced transformer voltage is provided to the second Zener diode during an occurrence of arcing and the produced transformer voltage is blocked from the second Zener diode during normal operation, wherein the second Zener diode has a second reverse breakdown voltage to reduce the produced transformer voltage provided thereto; and an output terminal connected to the second Zener diode to provide the reduced produced transformer voltage to the ballast to indicate that an occurrence of arcing has been detected.

In a related embodiment, the arc detection circuit may further include: a rectifier circuit connected between the secondary side of the transformer and the series-connected first Zener diode and second Zener diode, wherein the rectifier circuit rectifies the produced transformer voltage. In a further related embodiment, the rectifier circuit may be a full bridge rectifier. In another further related embodiment, the arc detection circuit may further include a capacitor connected between the rectifier circuit and the series-connected first Zener diode and second Zener diode, wherein the capacitor stores the rectified produced transformer voltage.

In another related embodiment, the arc detection circuit may further include: a capacitor connected between the secondary side of the transformer and the series-connected first Zener diode and second Zener diode, wherein the capacitor stores the produced transformer voltage.

In another embodiment, there is provided a ballast. The ballast includes: a rectifier to receive an alternating current (AC) voltage signal and to produce a rectified voltage signal therefrom; a power factor correction circuit electrically connected to the rectifier to receive the rectified voltage signal and to provide a corrected voltage signal; an inverter circuit electrically connected to the power factor correction circuit to receive the corrected voltage signal and to generate an oscillating power signal as a function thereof; a resonant tank circuit electrically connected to the inverter circuit to receive the oscillating power signal and therefrom provide a lamp current having a particular frequency to a lamp connected to the ballast; a controller to controller the inverter circuit; and an arc detection circuit electrically connected to the controller, wherein the arc detection circuit comprises: a transformer connected in series with the resonant tank circuit, wherein the transformer produces a transformer voltage that is greater than a threshold value during an occurrence of arcing; wherein the arc detection circuit is configured to provide a detection signal to the controller as a function of the transformer producing a transformer voltage greater than the threshold value; and wherein the controller is configured to shut down the inverter circuit in response to receiving the detection signal.

In a related embodiment, the transformer of the arc detection circuit may have a primary side and a secondary side, wherein the primary side of the transformer may be connected in series with the resonant tank circuit to receive the lamp current from the resonant tank circuit, and wherein the secondary side of the transformer may be electrically connected to the controller. In a further related embodiment, the secondary side of the transformer may produce the transformer voltage as a function of the lamp current received by the primary side of the transformer, wherein the transformer voltage may be greater than the threshold value during an occurrence of arcing and the transformer voltage may be less than the threshold value during normal operation of the ballast. In a further related embodiment, the ballast may further include: a first Zener diode and a second Zener diode connected together in series to the secondary side of the transformer, each of the first Zener diode and the second Zener diode having an anode and a cathode, the anode of the first Zener diode connected to the cathode of the second Zener diode, the cathode of the first Zener diode connected to the secondary side of the transformer to receive the transformer voltage, the anode of the second Zener diode connected to ground potential.

In a further related embodiment, the first Zener diode may have a first reverse breakdown voltage that corresponds to the threshold value, so that the transformer voltage may be provided to the second Zener diode during an occurrence of arcing and the transformer voltage may be blocked from the second Zener diode during normal operation. In a further related embodiment, the second Zener diode may have a second reverse breakdown voltage to reduce the transformer voltage provided thereto, wherein the detection signal may be formed by the reduced transformer voltage.

In another further related embodiment, the controller may be connected to the anode of the first Zener diode and the cathode of the second Zener diode.

In yet another further related embodiment, the ballast may further include: a rectifier circuit connected between the secondary side of the transformer and the series-connected first Zener diode and second Zener diode, wherein the rectifier circuit rectifies the transformer voltage. In a further related embodiment, the rectifier circuit is a full bridge rectifier. In another further related embodiment, the ballast may further include: a capacitor connected between the rectifier circuit and the series-connected first Zener diode and second Zener diode, wherein the capacitor stores the rectified transformer voltage.

In still another further related embodiment, the ballast may further include: a capacitor connected between the secondary side of the transformer and the series-connected first Zener diode and second Zener diode, wherein the capacitor stores the transformer voltage.

In another related embodiment, the ballast may further include: a direct current (DC) blocking capacitor configured for connecting in series with the lamp to block DC current from the lamp. In yet another related embodiment, the resonant tank circuit may include a capacitor and an inductor. In still another related embodiment, the ballast may further include: a shunt capacitor connected across the power factor correction circuit, between the power factor correction circuit and the inverter circuit.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
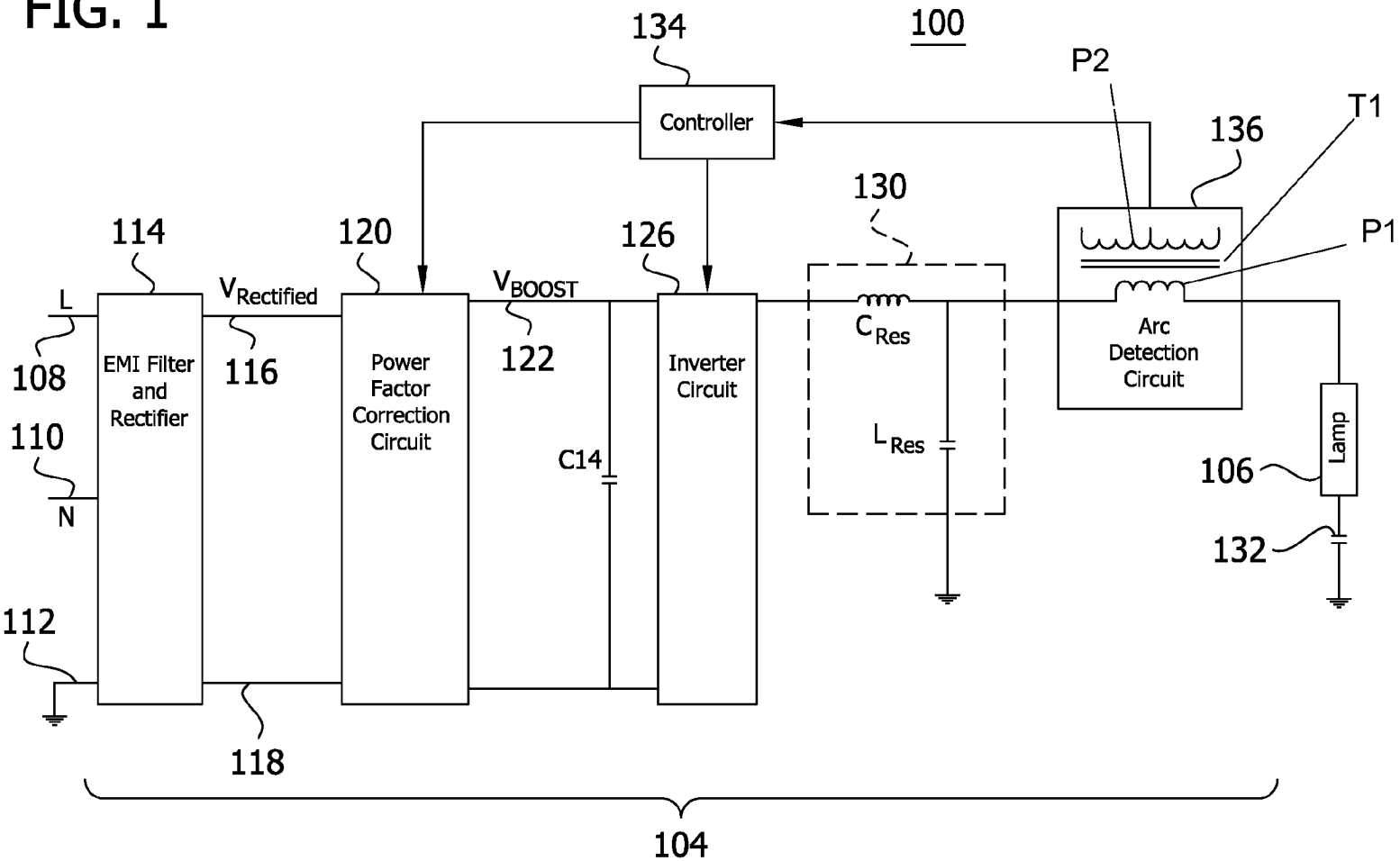
FIG. 1 is a schematic diagram, partially in block form, of a lamp system according to embodiments disclosed herein.

FIG. 1 illustrates a lamp system 100. The lamp system 100 includes an input power source (not shown), such as but not limited to an alternating current (AC) power supply, an electronic ballast 104 (hereinafter ballast 104), and a lamp 106. The ballast 104 may be, but is not limited to, an instant start ballast, a rapid start ballast, a programmed start ballast, or any other electronic ballast known in the art. In some embodiments, the lamp 106 is a T8 fluorescent lamp available from OSRAM SYLVANIA, Philips, or General Electric. However, the scope of the application contemplates the use of other types of lamps as well. Additionally, as described below, the lamp system 100 may include a plurality of lamps 106 connected together in parallel or in series.

The ballast 104 includes at least one high voltage input terminal (i.e., line voltage input terminal) 108 adapted for connecting to an alternating current (AC) power supply (e.g., standard 120V AC household power), a neutral input terminal 110, and a ground terminal 112 connectable to ground potential. An input AC power signal is received by the ballast 104 from the AC power supply via the high voltage input terminal 108. The ballast 104 includes an electromagnetic interference (EMI) filter and a rectifier (e.g., full-wave rectifier) 114, which are illustrated together in FIG. 1. The EMI filter portion of the EMI filter and rectifier 114 prevents noise that may be generated by the ballast 104 from being transmitted back to the AC power supply. The rectifier portion of the EMI filter and rectifier 114 converts AC voltage received from the AC power supply to a rectified voltage. The rectifier portion includes a first output terminal connected to a DC bus 116 and a second output terminal connected to a ground potential at ground connection point 118. Thus, the EMI filter and rectifier 114 outputs a rectified voltage ($V_{Rectified}$) on the DC bus 116.

A power factor correction circuit 120, which may, in some embodiments, be a boost converter, is connected to the first and second output terminals of the EMI filter and rectifier 114. The power factor correction circuit 120 receives the rectified voltage ($V_{Rectified}$) and produces a high voltage ($V_{Boost}$) on a high DC voltage bus ("high DC bus") 122. A shunt capacitor C14 is connected across the output of the power factor correction circuit 120. An inverter circuit 126 has an input connected to the power factor correction circuit 120 for receiving the high voltage ($V_{Boost}$) from the power factor correction circuit 120. The inverter circuit 126 is configured to convert the high voltage ($V_{Boost}$) from the power factor correction circuit 120 to an oscillating power signal for supplying to the lamp 106. In some embodiments, the inverter circuit 126 includes a first switching component and a second switching component. The first and second switching components complementarily operate between a non-conductive state and a conductive state in order to produce the oscillating power signal. A resonant tank circuit 130 is connected to the inverter circuit 126. The resonant tank circuit 130 generates a power signal having a particular frequency for providing to the lamp 106. In FIG. 1, a capacitor $C_{Res}$ and an inductor $L_{Res}$ are connected together and form the resonant tank circuit 130. A direct current (DC) blocking capacitor 132 is also connected in series with the lamp 106 for blocking DC current from flowing into the lamp 106.

The lamp system 100 includes a controller 134 for controlling components of the lamp system 100. In some embodiments, the lamp system 100 also includes a power supply (VCC) house keeping circuit (not illustrated) for powering components of the lamp system 100, including the controller 134. In FIG. 1, the controller 134 includes one or more output terminals that connect the controller 134 to the power factor correction circuit 120, and the controller 134 generates one or more output signals that are provided to the power factor correction circuit 120 via the output terminals in order to control the power factor correction circuit 120. Similarly, the controller 134 includes and one or more output terminals that connect the controller 134 to the inverter circuit 126, and the controller 134 generates on or more output signals that are provided to the inverter circuit 126 in order to control the inverter circuit 126. For example, as described below, in response to an occurrence of arcing in the lamp system 100, the controller 134 generates a shutdown output signal that is provided to the inverter circuit 126 in order to disable the inverter circuit 126 from providing the power signal used to energize the lamp 106.

An arc detection circuit 136 is connected between the ballast 104 and the lamp 106 for detecting an occurrence of arcing in the lamp system 100 and providing a detection signal to the ballast 104 indicating that an occurrence of arcing has been detected in the lamp system 100. It should be noted that the arc detection circuit 136 may be housed within the ballast 104 or separate from the ballast 104. The arc detection circuit 136 is electrically connected to the resonant tank circuit 130 and is configured for connecting in series with the lamp 106 for detecting an occurrence of arcing between the ballast 104 and the lamp 106. The arc detection circuit 136 is electrically connected to the controller 134 for providing the detection signal to the controller 134 when an occurrence of arcing has been detected. In response to receiving the detection signal, the controller 134 disables the inverter circuit 126 and the arcing is thereby quenched.

The arc detection circuit 136 includes a transformer T1 connected in series with the resonant tank circuit 130. The transformer T1 has a primary side having a primary winding P1 and a secondary side having a secondary winding P2. The primary winding P1 is connected in series with the resonant tank circuit 130 and the lamp 106. More specifically, the primary winding P1 is connected in series with a filament circuit of the lamp 106. As noted above, the lamp 106 may include a single lamp or a plurality of lamps connected together in a series or a parallel arrangement. In embodiments in which the lamp 106 includes a plurality of lamps, the primary winding P1 of the transformer T1 is connected in series to any one filament circuit of the plurality of lamps 106. During operation, the primary winding P1 of the transformer T1 receives the power signal (e.g., lamp current) generated by the resonant tank circuit 130 and conducts the lamp current to the lamp 106. As such, a primary transformer voltage is generated across the primary winding P1 of the transformer T1 as a function of the lamp current. The primary transformer voltage is reflected to the secondary side of the transformer T1 so that a secondary transformer voltage is produced across the secondary winding P2 as a function of the primary transformer voltage.

Accordingly, during normal operation of the ballast 104 (i.e., the lamp 106 is being energized without arcing) a first secondary transformer voltage is produced across the secondary winding P2 based on the lamp current conducted by the primary winding P1. During an occurrence of arcing, the lamp current spikes. As such, a second secondary transformer voltage, which is greater than the first secondary transformer voltage, is produced across the secondary winding P2 as a result of the spiked lamp current received by the primary winding P1. Thus, during an occurrence of arcing, the secondary transformer voltage is greater than a threshold value, whereas during normal operation the secondary transformer voltage is less than the threshold value. In some embodiments, the transformer T1 is configured so that the secondary side increases (e.g., amplifies) the primary voltage reflected to the secondary side of the transformer T1. The secondary transformer voltage is, thus, greater than the primary transformer voltage and a determination of the secondary transformer voltage relative to the threshold value is more easily and accurately ascertained.

Figure 2:
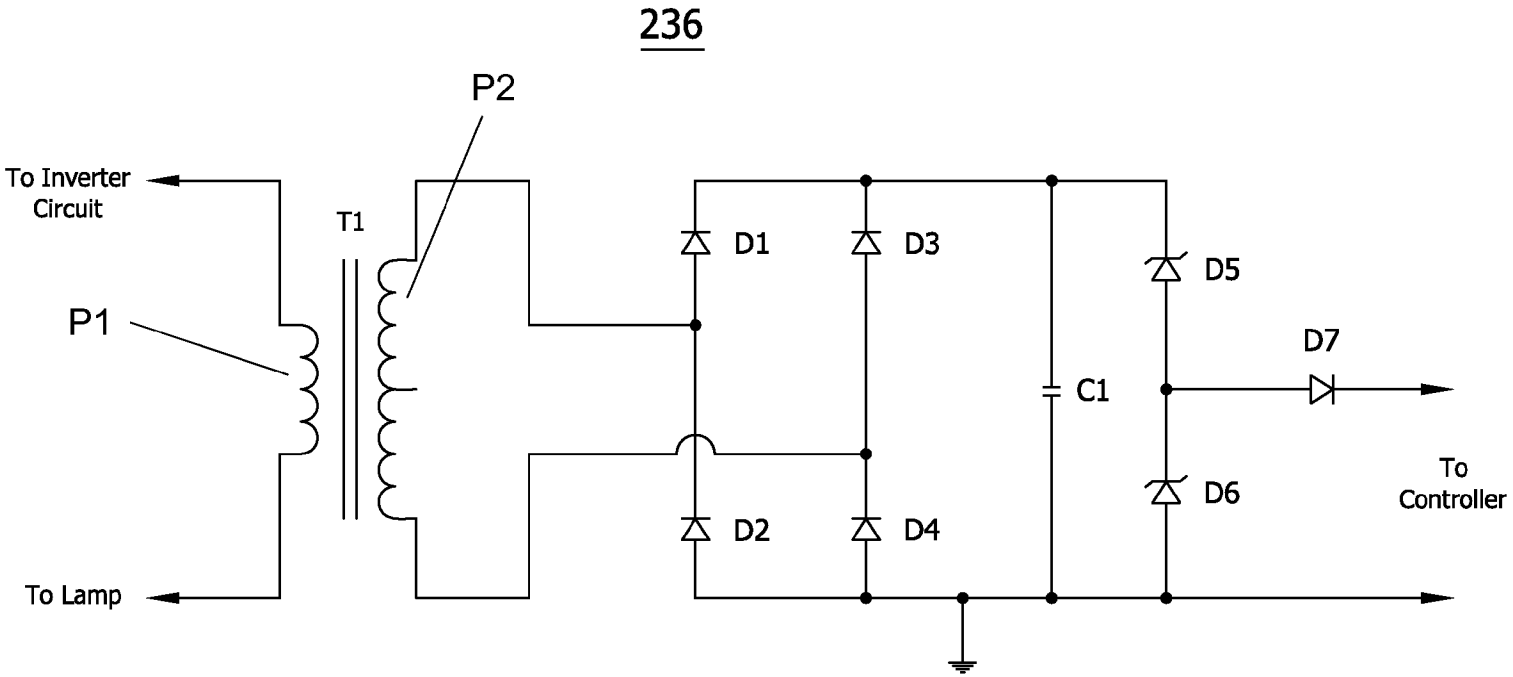
FIG. 2 is a schematic diagram of an exemplary arc detection circuit according to embodiments disclosed herein.

FIG. 2 illustrates an exemplary arc detection circuit 236. In addition to the transformer T1 described above, the arc detection circuit 236 includes a rectifier circuit on the secondary side of the transformer T1 for rectifying the secondary transformer voltage. In FIG. 2, the rectifier circuit is a full bridge rectifier comprising diodes D1, D2, D3, and D4 that are connected across the secondary winding P2 of the transformer T1. A capacitor C1 is connected to the rectifier circuit for storing the rectified secondary transformer voltage. A first diode D5 and a second diode D6 are connected together in series, and the series-connected first and second diodes, D5 and D6, are connected in parallel with the capacitor C1. The first and second diodes, D5 and D6, each have anode and a cathode. The anode of the first diode D5 is connected to the cathode of the second diode D6, and the cathode of the first diode D5 is connected to the secondary winding P2 of the transformer T1 via the rectifier circuit. The anode of the second diode D6 is connected to ground potential. The anode of the first diode D5 and the cathode of the second diode D6 are connected via a third diode D7 to an output terminal of the arc detection circuit 236. The output terminal of the arc detection circuit 236 is electrically connected to the controller 134 for providing the detection signal thereto.

As shown in FIG. 2, the first diode D5 and the second diode D6 are each Zener diodes. The first diode D5 has a reverse breakdown voltage ("first breakdown voltage") that corresponds to the threshold voltage, so that the rectified secondary transformer voltage is provided to the second diode D6 when the secondary transformer voltage is greater than the threshold voltage. In other words, the first diode D5 conducts the rectified secondary transformer voltage to the second diode D6 during an occurrence of arcing, and blocks the rectified secondary transformer voltage from being conducted to the diode D6 during normal operation of the ballast 104 and the lamp (or plurality of lamps) 106. The second diode D6 has a reverse breakdown voltage ("second reverse breakdown voltage") that reduces (i.e., decreases, lessens) the rectified secondary transformer voltage received from the first diode D5. Thus, the second diode D6 provides a reduced rectified secondary transformer voltage to the output terminal of the arc detection circuit 236. The reduction in the rectified secondary transformer voltage by diode D6 prevents the controller 134 from receiving very high voltage during an occurrence of arcing, which could damage the controller 134. Since the first diode D5 blocks the rectified secondary transformer voltage from the second diode D6 during normal operation and provides the rectified secondary transformer voltage to the second diode D6 during an occurrence of arcing, the output terminal receives the reduced rectified secondary transformer voltage and provides it to the controller 134 as a function of an occurrence of arcing (e.g., only when there is an occurrence of arcing, not during normal operation). Accordingly, the reduced rectified secondary transformer voltage forms the detection signal that is sent to the controller 134 to indicate that an occurrence of arcing has been detected.

Thus, the ballast 104 receives the detection signal from the arc detection circuit 236 when an occurrence of arcing occurs. In response to receiving the detection signal, the ballast 104 shuts down so that no power signal is provided to the lamp 106. Referring to the lamp system 100 illustrated in FIG. 1, the controller 134 receives the detection signal from the arc detection circuit 136, 236, and in response thereto shuts down the inverter circuit 126. As such, the lamp 106 is shut down and the arcing is quenched. The arc detection circuit 136, 236 thereby protects the lamp system 100 from damage to the lamp system 100 caused by an occurrence of arcing and prevents safety hazards, such as ignition of a fire, that may likewise be caused by an arcing occurrence.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer (s), workstation(s) (e.g., Sun, HP), personal digital assistant (s) (PDA(s)), handheld device(s) such as cellular telephone(s) or smart cellphone(s), laptop(s), handheld computer(s), or another device(s) capable of being integrated with a processor (s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. An arc detection circuit to detect an occurrence of arcing between a ballast and a lamp, the arc detection circuit comprising:

a transformer having a primary side and a secondary side, wherein the primary side is configured for connecting between the ballast and the lamp to receive lamp current and conduct the lamp current from the ballast to the lamp during normal operation, wherein the secondary side of the transformer produces a transformer voltage as a function of the lamp current received by the primary side, and wherein the produced transformer voltage is less than a threshold value during normal operation and is greater than the threshold value during an occurrence of arcing between the ballast and the lamp;

a first Zener diode and a second Zener diode connected together in series to the secondary side of the transformer, each of the first Zener diode and the second Zener diode having an anode and a cathode, the anode of the first Zener diode connected to the cathode of the second Zener diode, the cathode of the first Zener diode connected to the secondary side of the transformer to receive the produced transformer voltage, the anode of the second Zener diode connected to ground potential, wherein the first Zener diode has a first reverse breakdown voltage that corresponds to the threshold value so that the produced transformer voltage is provided to the second Zener diode during an occurrence of arcing and the produced transformer voltage is blocked from the second Zener diode during normal operation, wherein the second Zener diode has a second reverse breakdown voltage to reduce the produced transformer voltage provided thereto; and an output terminal connected to the second Zener diode to provide the reduced produced transformer voltage to the ballast to indicate that an occurrence of arcing is detected.

2. The arc detection circuit of claim 1, further comprising:

a rectifier circuit connected between the secondary side of the transformer and the series-connected first Zener diode and second Zener diode, wherein the rectifier circuit rectifies the produced transformer voltage.

3. The arc detection circuit of claim 2, wherein the rectifier circuit is a full bridge rectifier.

4. The arc detection circuit of claim 2, further comprising:

a capacitor connected between the rectifier circuit and the series-connected first Zener diode and second Zener diode, wherein the capacitor stores the rectified produced transformer voltage.

5. The arc detection circuit of claim 1, further comprising:

a capacitor connected between the secondary side of the transformer and the series-connected first Zener diode and second Zener diode, wherein the capacitor stores the produced transformer voltage.

6. A ballast comprising:

a rectifier to receive an alternating current (AC) voltage signal and to produce a rectified voltage signal therefrom;

a power factor correction circuit electrically connected to the rectifier to receive the rectified voltage signal and to provide a corrected voltage signal;

an inverter circuit electrically connected to the power factor correction circuit to receive the corrected voltage signal and to generate an oscillating power signal as a function thereof;

a resonant tank circuit electrically connected to the inverter circuit to receive the oscillating power signal and therefrom provide a lamp current having a particular frequency to a lamp connected to the ballast;

a controller to controller the inverter circuit; and an arc detection circuit electrically connected to the controller, wherein the arc detection circuit comprises:

a transformer connected in series with the resonant tank circuit, wherein the transformer produces a transformer voltage that is greater than a threshold value during an occurrence of arcing;

wherein the arc detection circuit is configured to provide a detection signal to the controller as a function of the transformer producing a transformer voltage greater than the threshold value; and wherein the controller is configured to shut down the inverter circuit in response to receiving the detection signal.

7. The ballast of claim 6, wherein the transformer of the arc detection circuit has a primary side and a secondary side, wherein the primary side of the transformer is connected in series with the resonant tank circuit to receive the lamp current from the resonant tank circuit, and wherein the secondary side of the transformer is electrically connected to the controller.

8. The ballast of claim 7, wherein the secondary side of the transformer produces the transformer voltage as a function of the lamp current received by the primary side of the transformer, wherein the transformer voltage is greater than the threshold value during an occurrence of arcing and the transformer voltage is less than the threshold value during normal operation of the ballast.

9. The ballast of claim 8, further comprising:

a first Zener diode and a second Zener diode connected together in series to the secondary side of the transformer, each of the first Zener diode and the second Zener diode having an anode and a cathode, the anode of the first Zener diode connected to the cathode of the second Zener diode, the cathode of the first Zener diode connected to the secondary side of the transformer to receive the transformer voltage, the anode of the second Zener diode connected to ground potential.

10. The ballast of claim 9, wherein the first Zener diode has a first reverse breakdown voltage that corresponds to the threshold value, so that the transformer voltage is provided to the second Zener diode during an occurrence of arcing and the transformer voltage is blocked from the second Zener diode during normal operation.

11. The ballast of claim 10, wherein the second Zener diode has a second reverse breakdown voltage to reduce the transformer voltage provided thereto, wherein the detection signal is formed by the reduced transformer voltage.

12. The ballast of claim 9, wherein the controller is connected to the anode of the first Zener diode and the cathode of the second Zener diode.

13. The ballast of claim 9, further comprising:

a rectifier circuit connected between the secondary side of the transformer and the series-connected first Zener diode and second Zener diode, wherein the rectifier circuit rectifies the transformer voltage.

14. The ballast of claim 13, wherein the rectifier circuit is a full bridge rectifier.

15. The ballast of claim 13 further comprising:

a capacitor connected between the rectifier circuit and the series-connected first Zener diode and second Zener diode, wherein the capacitor stores the rectified transformer voltage.

16. The ballast of claim 9, further comprising:

a capacitor connected between the secondary side of the transformer and the series-connected first Zener diode and second Zener diode, wherein the capacitor stores the transformer voltage.

17. The ballast of claim 6, further comprising:

a direct current (DC) blocking capacitor configured for connecting in series with the lamp to block DC current from the lamp.

18. The ballast of claim 6, wherein the resonant tank circuit comprises a capacitor and an inductor.

19. The ballast of claim 6, further comprising:

a shunt capacitor connected across the power factor correction circuit, between the power factor correction circuit and the inverter circuit.

* * * * *